US005209159A

United States Patent [19]

Asanuma

[11] Patent Number: 5,209,159

[45] Date of Patent: May 11, 1993

[54] PRINTING PRESS

[75] Inventor: Kiyohisa Asanuma, Kawasaki, Japan

[73] Assignee: Tokyo Kikai Seisakusho, Ltd., Tokyo, Japan

[21] Appl. No.: 875,638

[22] Filed: Apr. 28, 1992

[30] Foreign Application Priority Data

Jun. 21, 1991 [JP] Japan ..... 3-175921

[51] Int. Cl.[5] ..... B41J 1/60

[52] U.S. Cl. ..... 101/112; 101/212

[58] Field of Search ..... 101/112, 212, 216, 219, 101/220, 221, 174, 178, 179, 180, 181, 228; 51/268; 254/2 C

[56] References Cited

U.S. PATENT DOCUMENTS 4,393,772 7/1983 Burger ..... 101/228
4,401,028 8/1983 Kobler et al. ..... 101/178
4,412,490 11/1983 Grosshauser ..... 101/180

FOREIGN PATENT DOCUMENTS 0197803 9/1976 Fed. Rep. of Germany ..... 101/228

OTHER PUBLICATIONS

IFRA Newspaper Techniques English Edition, issued by INCA-FIEJ Research Association, Nov., 1987, p. 71, the same journal, Apr. 1988, pp. 64-73, the same journal, Apr. 1989, p. 69, FIG. 3.

*Primary Examiner*—Edgar S. Burr
*Assistant Examiner*—Anthony H. Nguyen
*Attorney, Agent, or Firm*—Armstrong, Westerman, Hattori, McLeland & Naughton

[57] ABSTRACT

A printing press comprising press units inclusive of a press unit that does not correspond to a standard floor, the press units being stacked in stages. The standard floor is provided with an operation floor that faces a press unit and with an operation floor hoist means for moving the operation floor up and down. When a press unit is situated at an intermediate stage which renders the operator difficult to work on the operation floor at the height of the standard floor, the operator go on board the operation floor, actuates the operation floor hoist means to raise the operation floor to a predetermined position or a suitable position and stops it, and then carries out the operation for the press unit of the intermediate stage maintaining stable attitude.

5 Claims, 2 Drawing Sheets

PRINTING PRESS

BACKGROUND OF THE INVENTION

1. Field of the Invention

The present invention relates to a printing press in which a plurality of press units are stacked in the direction of height.

2. Description of the Prior Art

With the trend toward printing, for example, newspapers in many colors, that has increasingly produced technical demands to effect the printing in large quantities in many pages and in many colors while effectively utilizing the limited area of installation facilities, the printing press has been constructed in a form in which a plurality of press units are stacked in the direction of height.

FIGS. 2 and 3 illustrate printing presses of the forms according to the prior art.

That is, four press units P are installed so that they are stacked upon one another, each of which having at least two sets of blanket cylinders BC and plate cylinders PC with ink feeders IS in a manner that the blanket cylinders BC are arranged on the right and left sides to come in pressed contact with each other. A paper web W is allowed to run between the two blanket cylinders BC and BC that are in press contact with each other in each of the four press units P, in order to effect the printing using one to four colors (e.g., see IFRA Newspaper Techniques English Edition, issued by INCA-FIEJ Research Association, November, 1987, p. 71, the same journal, April, 1988, pp. 64–73, the same journal, April 1989, p. 69, FIG. 3).

In the above-mentioned conventional printing press in which the press units are stacked, it is virtually impossible to carry out various operations for every press unit on the operation floor of the same height. As shown in FIG. 3, for instance, the operation floors are constructed partly in a jump-up type and are provided at a plurality of levels and, further, stairways are provided to connect the operation floors resulting in a complex structure as a whole.

Furthermore, the operator is obliged to move between the operation floors and must bear considerable physical and mental burdens.

SUMMARY OF THE INVENTION

The object of the present invention is to greatly simplify the structure of the operation floor of the printing press and to reduce the burden of the operators who have to move up and down among the operation floors.

According to the present invention, the printing press comprises a plurality of stages of press units that are stacked, operation floors provided for the press units, and operation floor hoist means for moving the operation floors up and down.

The operators carry out various operations for the press units in the printing press. Here, when a printing press is situated at an intermediate stage which renders the operator difficult to work on the operation floor at a standard floor height, the operator gets on board the operation floor, actuates the operation floor hoist means, stops the operation floor after it is raised to a predetermined position or a suitable position, and carries out various operations for the press unit of the intermediate stage maintaining a stable posture. After the operations are finished, the operator actuates the operation floor hoist means again to lower the operation floor to the height of the standard floor.

The above and other objects, features and advantages of the present invention will become apparent from reading of the following description which has been made in connection with the accompanying drawings.

BRIEF DESCRIPTION OF THE DRAWINGS

The present invention is illustrated in the following drawings in which.

DESCRIPTION OF THE PREFERRED EMBODIMENT

Figure 1:
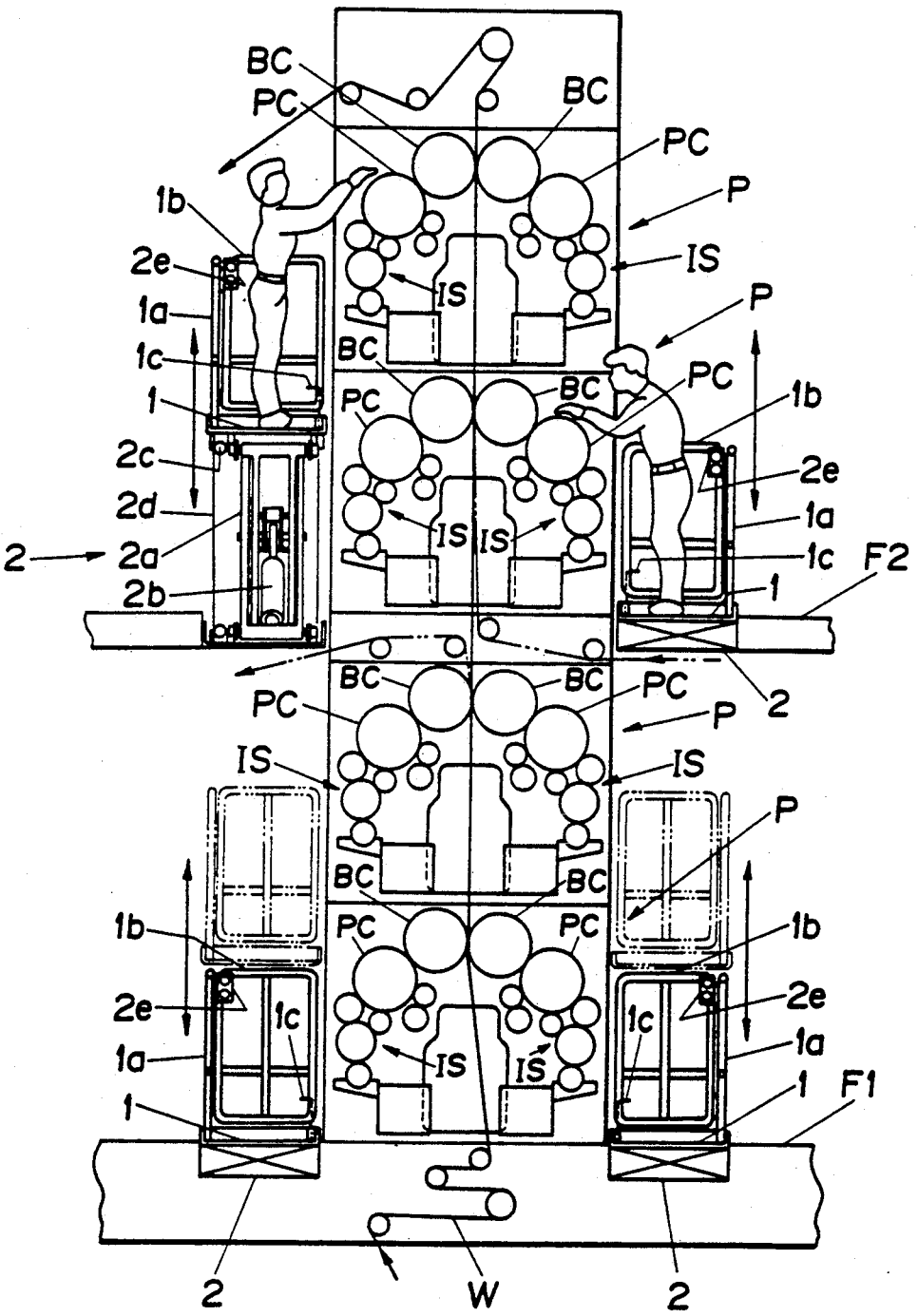
FIG. 1 is a diagram which schematically illustrates the constitution of a printing press according to an embodiment of the present invention.
Figure 2:
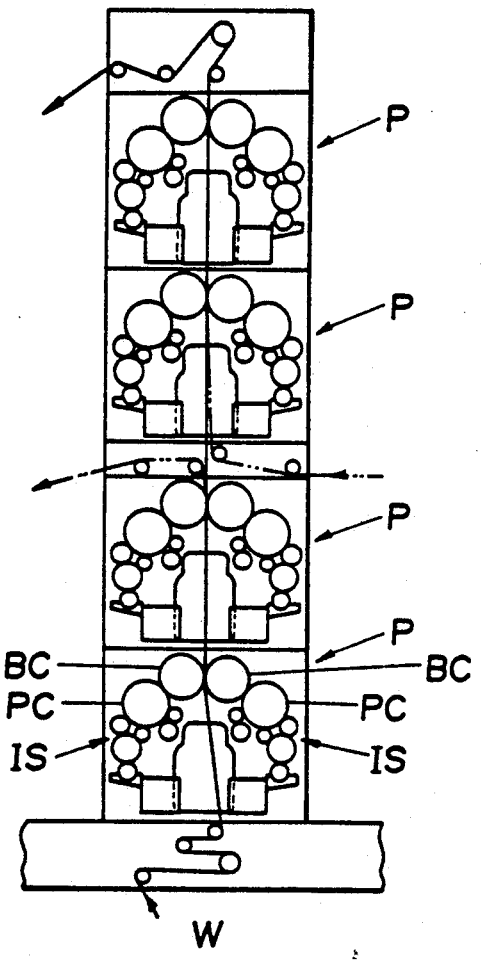
FIG. 2 PRIOR ART
FIG. 2 is a diagram which schematically illustrates the constitution of a printing press according to a prior art.
Figure 3:
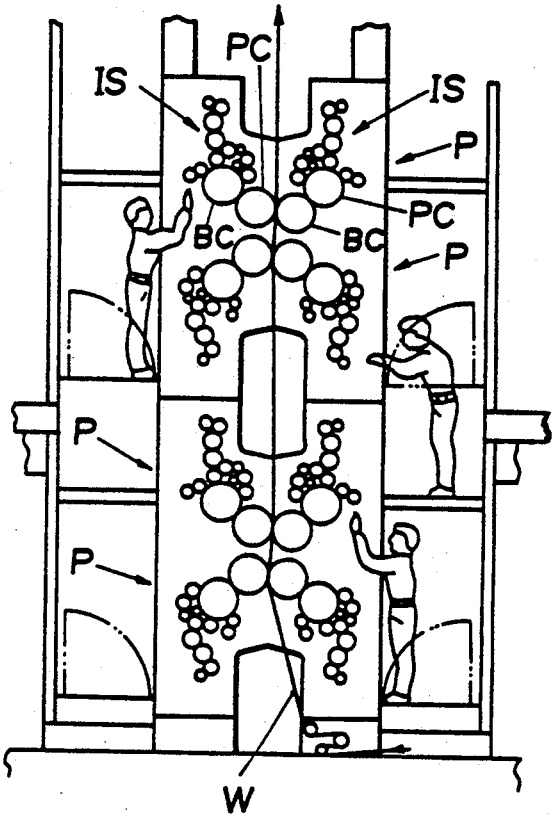
FIG. 3 PRIOR ART
FIG. 3 is a diagram which schematically illustrates the constitution of a printing press according to another prior art.

The printing press according to an embodiment of the present invention will now be described with reference to FIG. 1.

The printing press has press units P that are stacked upon one another in four stages, each of which press units P being comprised of two sets of blanket cylinders BC and plate cylinders PC with ink feeders IS in a manner that the blanket cylinders BC are arranged on the right and left sides to come into pressed contact with each other. A paper web W is permitted to run between the two blanket cylinders BC and BC that are in press contact with each other in each of the press units P that are stacked in four stages, in order to effect the printing using one to four colors.

The press units P are stacked in four stages from a lower standard floor F1 penetrating through an upper standard floor F2. In the diagramed embodiment, the lower standard floor F1 corresponds to the level where the press unit P of the first stage is installed and the upper standard floor F2 corresponds to the level where the press unit P of the third stage is installed.

On the lower standard floor 1 (upper standard floor F2) are provided operation floors 1 that extend in parallel with the axis of the plate cylinder PC on both outer sides with the press units P sandwiched therebetween, as well as operation floor hoist means 2 that support the operation floors 1 from the lower side to move them up and down.

The operation floor hoist means 2 comprises suitable parallel crank mechanisms 2*a*, a hydraulic pressure drive means 2*b* for driving them up, and roll curtains 2*d* for shielding four sides of a space that is formed between the lower surface of the ascending operation floor 1 and the lower standard floor F1 (upper standard floor F2) or for shielding three sides except one side that faces the press units P. FIG. 1 illustrates roll curtains 2*d* that shield three sides. The roll curtains 2*d* have their lower ends that are fastened to the lower standard floor F1 (upper standard floor F2) and have their upper ends that are taken up by an automatic take-up holding unit 2*c* attached to the lower surface of the operation floor 1.

Moreover, a fence 1*a* is provided on the operation floor 1 along the four sides or the three sides except one side facing the press unit P in order to prevent the operator from falling. The fence 1*a* has at least one door 1*b* through which the operator is allowed to get on board or off the operation floor 1. The door 1*b* is equipped with a fall-type locking means 1*c* that can be locked when the door 1*b* is closed. Furthermore, the fence 1*a* has at least one operation unit 2*e* with which the drive means 2*b* can be operated to move the operation floor 1 up and down.

To carry out various operations for the press units in the above-mentioned printing press, the operator opens the door 1*b* of the lower standard floor F1 (upper standard floor F2) to enter the operation floor 1 surrounded by the fence 1*a*, and closes the door 1*b* which is then locked by the fall-type locking means 1*c*.

In the case of the operation for the press units P of the first and third stages, the operation can be carried out directly. In the case of the operation for the press units P of the second and fourth stages, however, the operation unit 2*e* is operated to actuate the drive unit 2*b* in order to raise the operation floor 1 by an extending parallel crank mechanism 2*a* up to a predetermined position or a suitable position and then to stop it. The operation can then be carried out for the press units P of the second and fourth stages at that position maintaining a stable posture. After the operation, the operation unit 2*e* is operated again to actuate the drive means 2*b*. The operation floor 1 is lowered to the lower standard floor F1 (upper standard floor F2) by the folding parallel crank mechanism 2*a*. The operator releases the fall-type locking means 1*c*, opens the door 1*b*, and steps onto the lower standard floor F1 (upper standard floor F2).

Furthermore, the roll curtains 2*d* are withdrawn from the automatic take-up holding means 2*c* as the operation floor 1 rises, and at least three sides of the lower side of the operation floor 1 are shielded by the roll curtains 2*d*. This prevents the operator from inadvertently entering the lower side of the operation floor 1 while the floor is moving up or down or is stopped at the elevated position.

The operator is prevented from falling while the operation floor 1 is moving up or down or when it is at a elevated position owing to the fence 1*a* that surrounds at least three sides of the operation floor 1 and the door 1*b* locked by the fall-type locking means 1*c*.

Though the above embodiment has employed the hydraulic pressure drive means 2*b* for driving up the parallel crank mechanism 2*a*, it is also allowable to use any other drive means such as an electric motor or the like. It is further allowable to provide any suitable safety means which locks the operation floor hoist means 2 under the non-operating condition in case the fall-type locking means 1*c* is not completely locked or in case the roll curtains 2*d* are under abnormal condition.

Moreover, the lower standard floor only may be constructed to move up and down passing through other standard floors, or may be so constructed as to handle all of the press units P without providing other standard floors.

According to the present invention, the operation floor on which the operator is board is moved up and down and is stopped at a predetermined position or at a suitable position in the printing press which is comprised of press units stacked in stages, and exhibits the following effects:

(1) There is no need for installing multiple levels of operation floors; i.e., constitution of the operation floors is simplified and the space of operation becomes neat.

(2) The operator is not required to move among the operation floors at all or frequently and, hence, has physical and spiritual burden reduced.

(3) The operation floor is set to a position where the operation can be done most easily; i.e., the operation need not be done under uncomfortable condition of posture, and the operation can be efficiently carried out maintaining safety in operation.

While the present invention has been described above with respect to a typical preferred embodiment thereof, it should of course be understood that the invention should not be limited only to it but various changes or modifications may be made without departing from the scope of the invention as defined by the appended claim.

What is claimed is:

1. A printing press, comprising:

a plurality of stages of press units that are stacked;

operation floors provided for the press units;

operation floor hoist means for moving the operation floors up and down, said operation floor hoist means positioned below the operation floors;

a curtain connected along at least three sides of the operation floors for shielding the space below the operation floors when moved upward; and a safety fence provided around at least three sides of the operation floors.

2. The printing press of claim 1, wherein each of said stages comprises a plurality of cylinders for passing a web there between, and wherein a separate operating floor is situated on opposite sides of the press units for access on opposite sides of the web.

3. The printing press of claim 2, wherein four of said press units are stacked.

4. The printing press of claim 3, wherein a lower standard floor is located at the level of the lowest stage and has two operation floors supported thereon and wherein an upper standard floor is located at a level of the third stage an has two operation floors supported thereon.

5. The printing press of claim 4, wherein said curtain comprises a roll curtain, said safety fence has an operation unit supported thereon, and including a fall-type blocking means.

* * * * *